US005647062A

United States Patent [19]

Nigbur

[11] Patent Number: 5,647,062

[45] Date of Patent: Jul. 15, 1997

[54] LIMB PROTECTOR

[76] Inventor: Mark R. Nigbur, 808 Cresta, Colorado Springs, Colo. 80906

[21] Appl. No.: 497,034

[22] Filed: Jun. 30, 1995

[51] Int. Cl.[6] ..... A41D 13/08

[52] U.S. Cl. ..... 2/16

[58] Field of Search ..... 2/2, 22, 24, 16

[56] References Cited

U.S. PATENT DOCUMENTS

| | | | |
|---|---|---|---|
| 930,740 | 8/1909 | Dean | 2/22 |
| 1,158,208 | 10/1915 | Hart | 2/22 |
| 1,264,916 | 5/1918 | Goldsmith | 2/22 X |
| 3,533,106 | 10/1970 | Kremp | 2/22 |
| 4,756,026 | 7/1988 | Pierce, Jr. | 2/16 |
| 5,168,576 | 12/1992 | Krent et al. | 2/2 |
| 5,465,424 | 11/1995 | Cudney et al. | 2/2 |
| 5,477,558 | 12/1995 | Volker et al. | 2/16 X |

OTHER PUBLICATIONS

Cooper Wrist Slash Guards, Great Skate Fall 1995 mail order catalog, published Sep. 1994, p. 55.

*Primary Examiner*—Paul C. Lewis

*Attorney, Agent, or Firm*—Lee R. Osman

[57] ABSTRACT

A limb protector which attaches to a limb and protects it from injury due to impact. The limb protector remains securely positioned on the limb, has a plurality of protective compartments for dissipating impact, and is positionable immediately adjacent to a joint without causing any interference with the joint's movement. The limb protector includes a main body member having opposing edges which define a length of the main body member. The main body member also has a protective compartment, which defines an interior cavity in which an insert member is positioned. An elongated attachment strap fastens the main body member to a limb, and has two opposing ends. A front edge extends across the width of the main body member between the opposing side edges and has an arcuate concave shape across the width of the main body member.

4 Claims, 3 Drawing Sheets

LIMB PROTECTOR

BACKGROUND OF THE INVENTION

1. Field of the Invention

This invention relates to a new and improved limb protector, and more particularly to a limb protector having a plurality of protective compartments containing insert members to allow the limb protector to securely conform to a user's limb yet provide protection against severe blows.

2. Description of the Prior Art

Injuries to limbs are common in many contact sports. For instance, in hockey, and other sports in which a stick is used, a player's forearms are subject to both intentional and inadvertent contact by another player's hockey stick. With the onset of shorter hockey gloves, the space between the player's elbow pad and the glove has increased, thereby exposing more of the player's arm and increasing the chance of injury.

Presently developed forearm protectors include terry cloth wristbands with molded poly inserts. A wristband of this type is not adequate for protecting the forearm because it is positionally unstable on the player's arm during use. The elasticized terry cloth does not provide a sufficiently secure fit to maintain the wristband's position on the player's forearm during the player's rigorous physical movements. Movement of the wristband on the player's arm causes the wristband to fail to provide constant protection. Further, the elasticized terry cloth wristband is not durable in that it stretches out and loses its shape, which further degrades the wristbands ability to stay in place on the player's arm.

The problems of making a forearm protector which stays in place, is comfortable, lightweight, and convenient to use, is durable and strong enough to withstand severe blows, have not been successfully resolved. It is to overcome these shortcomings, and others in the prior art, that the present invention was developed.

SUMMARY OF THE INVENTION

The present invention in general terms concerns a limb protector which attaches to a limb and protects it from injury due to impact, and more particularly to a limb protector that remains securely positioned on the limb, has a plurality of protective compartments for dissipating impact, and is positionable immediately adjacent to a joint without causing any interference with the joint's movement.

The limb protector of the present invention provides functionality that overcomes the aforementioned limitations and problems.

The limb protector of the present invention is attachable to a human limb, and includes a main body member having opposing edges which define a length of the main body member. The main body member also has a protective compartment, which defines an interior cavity in which an insert member is positioned. An elongated attachment strap fastens the main body member to a limb, and has two opposing ends. Each opposing end attaches to one of the opposing edges.

The main body member can have a plurality of protective compartments oriented parallel to the opposing edges, which also extend the length of the main body member. The protective compartments are adjacent to one another on the main body member, and the protective compartments are delineated from adjacent protective compartments by a line of connection, which forms a living hinge that allows the protective compartments to pivot independently of one another.

Padding material is also positioned in the interior cavity of each of the plurality of protective compartments.

In more detail, the main body member has a top and bottom surface; each being attached together along the line of connection between the adjacent protective compartments. The bottom surface of the main body member is substantially adjacent to the limb when the limb protector is fastened to the limb. The padding material is interposed between the insert member and the bottom surface of said main body member.

The main body member has a width between the opposing edges, and a front edge extends across the width of the main body member between the opposing side edges. The front edge has an arcuate concave shape across the width of the main body member, which reaches an apex at a midpoint of the width of the main body member.

The main body member has a width between the opposing edges, and a rear edge extends across the width of the main body member between the opposing side edges. The rear edge has an arcuate convex shape across the width of the main body member, reaching an apex at a midpoint of the width of the main body member.

The main body member has a first thickness measured at a point intermediate the lines of connection, and a second thickness measured at the lines of connection. The difference between the first thickness and the second thickness forms a trough on the bottom surface along each of the lines of connection in between the adjacent protective compartments. The bottom surface is closely adjacent to the limb at locations intermediate the troughs, and the bottom surface is displaced from said limb along the troughs, when the limb protector is fastened to the limb.

Accordingly, it is a primary object of the present invention to provide a limb protector that remains securely in place when fastened on a limb, such as a forearm.

It is another object of the present invention to provide a limb protector which can be positioned very close to a joint to provide protection without interfering with the movement of the joint.

It is still another object of the present invention to provide a limb protector which has multiple independent protective compartments that can adjust under impact to dissipate the force of the blow.

Other aspects, features, and details of the present invention can be more completely understood by reference to the following detailed description of a preferred embodiment, in conjunction with the drawings, and from the appended claims.

DESCRIPTION OF THE PREFERRED EMBODIMENT

Figure 1:
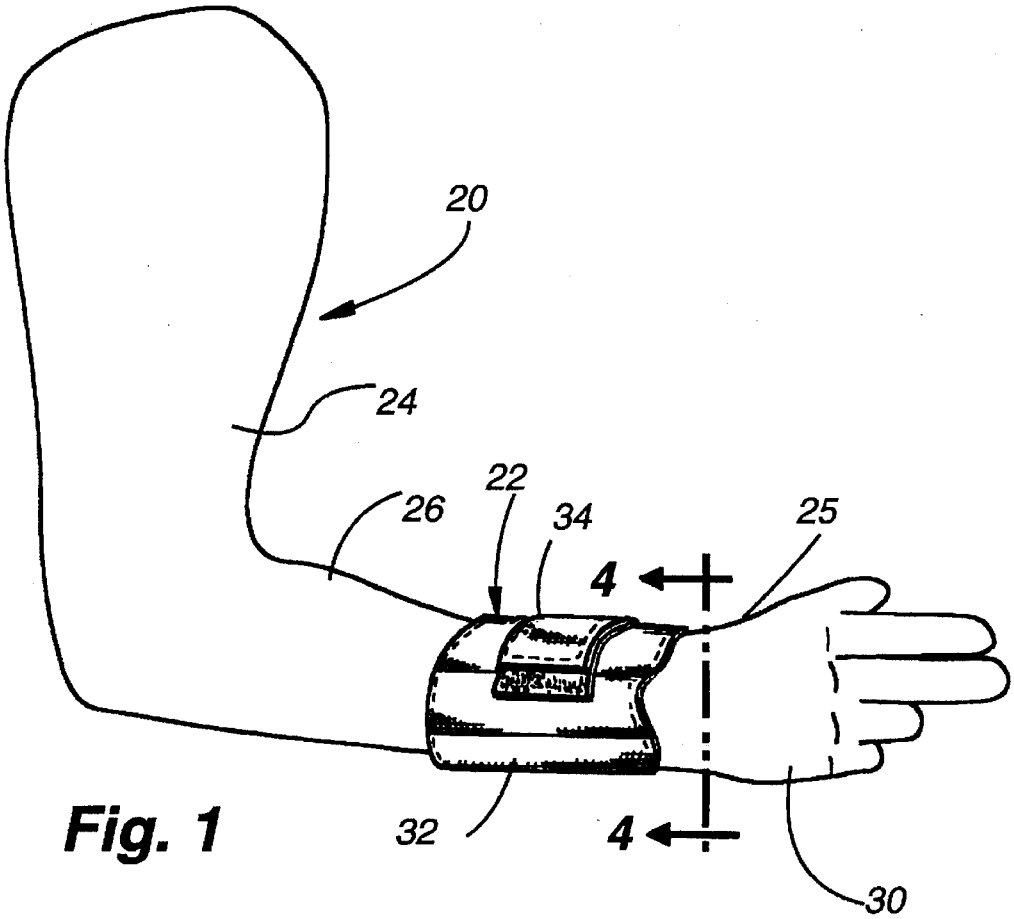
FIG. 1 is an isometric view of the limb protector of the present invention while mounted on an arm, illustrating a plurality of articulating compartments, and an attachment strap.

Referring first to FIG. 1, an arm 20 to which is attached the limb protector 22 of the present invention is illustrated, and includes an upper arm 24, a forearm 26, a wrist 28, and a hand 30. The limb protector is attached to the forearm adjacent to the wrist. The limb protector, in general, comprises a main body member 32 and an attachment strap 34 for securing the main body member on the forearm in a desired position. The attachment strap 34 is adjustable and releasable to allow the user to comfortably and securely position the main body member 32 on the forearm. The main body member is placed on the forearm in the orientation the user's believes is best suited to protect the forearm from harmful blows.

Figure 2:
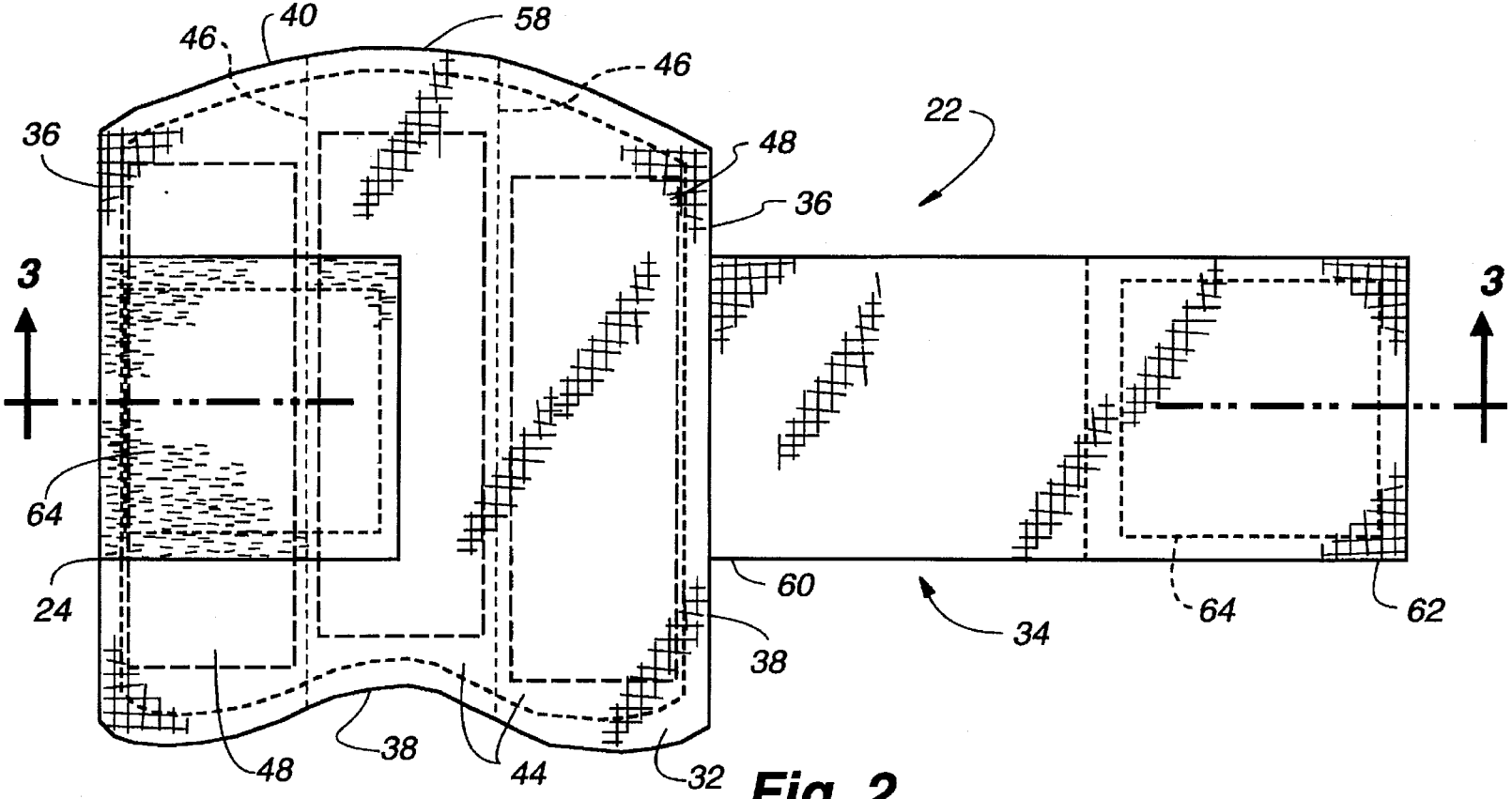
FIG. 2 is a top view of the limb protector of the present invention in an extended position.

The main body member 32, as shown in FIG. 2, defines two opposing parallel side edges 36 connected by opposing front 38 and rear 40 contoured edges, all of the edges together forming a perimeter 42. The main body member 32 is partitioned into a plurality of protective compartments 44. Each protective compartment 44 is attached to the adjacent protective compartment along a common line of connection 46. The protective compartments are pivotable with respect to one another to conform to the shape of the limb upon which the protector is attached. Each protective compartment contains an insert member 48, shown in dash in FIG. 2. The insert members 48 provide the majority of the impact protection to protect the forearm.

Figure 3:
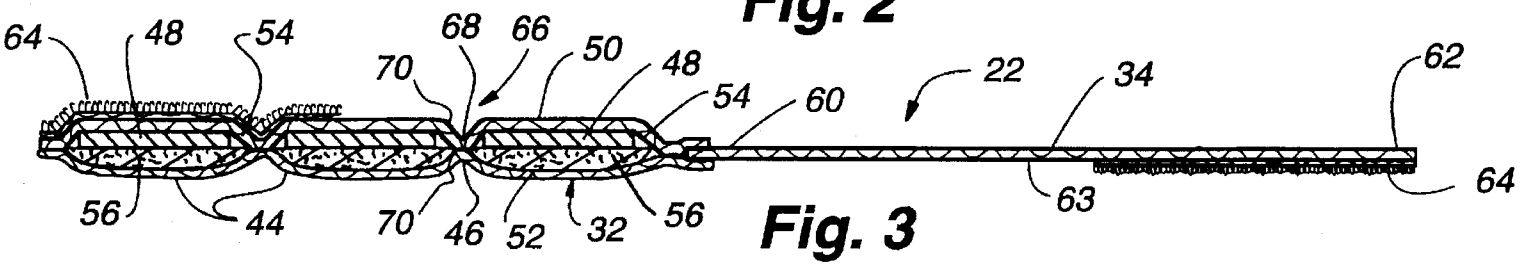
FIG. 3 is a section view taken along the line 3—3 of FIG. 2.

Referring to FIG. 3, the main body member 32 comprises a top surface 50 and a bottom surface 52, each made of knit, woven, or other suitable material. The top and bottom surfaces are connected together, by any adequate means such as sewing, around the perimeter 42. The top and bottom surfaces 50, 52 are also connected together, say by sewing, along the lines of connection 46 to connect the top and bottom surfaces and form the protective compartments 44. The protective compartments 44 are oriented in a direction parallel to the opposing parallel side edges 36 of the main body member 32. The sewing, or other adequate means of attaching the top and bottom surfaces, along the line of connection 46 form living hinges about which each protective compartment 44 independently pivots with respect to the adjacent protective compartment 44.

The protective compartments 44 each define an interior cavity 54 in which is positioned an insert member 48 and padding material 56. Each interior cavity 54 is dimensioned so as to be slightly wider and longer than the insert member 48, while maintaining the positional stability of the insert member inside the cavity 54 of the protective compartment 44. In the preferred embodiment, the insert members 48 are rectangular with a thickness sufficient to provide adequate impact protection. The insert members 48 can be a rigid material, such as polycarbonate, or an adequate flexible material, such as silicone sheeting.

The padding material 56, such as closed-cell foam, is positioned below the insert member 48 so as to be interposed between the bottom surface 52 and insert member 48. The padding 56 provides extra comfort and protection.

As shown in FIGS. 1 and 2, the front edge 38 of the main body member 32 has a contoured arcuate concave shape across the width of the main body member 32. The contour begins at the interface of the front edge 38 and each one of the side edges 36, and gently slopes from both side edges toward the rear edge 40 until the middle of the width (midpoint) of the main body member, where it reaches an apex. When this arcuate front edge 38 is positioned adjacent to the wrist of the user, it allows the user's hand 30 and wrist 28 to move without interference from the protector 22. This allows the user to position the protector 22 very close to a joint (i.e. wrist) without interfering with the motion of the joint while providing protection as close to the joint as desired.

The rear edge 40 of the main body member 32 is contoured in a convex shape away from the front edge 38. The rear edge 40 curves from both side edges 36 to an apex 58 at a midpoint of the width of the main body member 32, in a direction away from the front edge 38.

Figure 6:
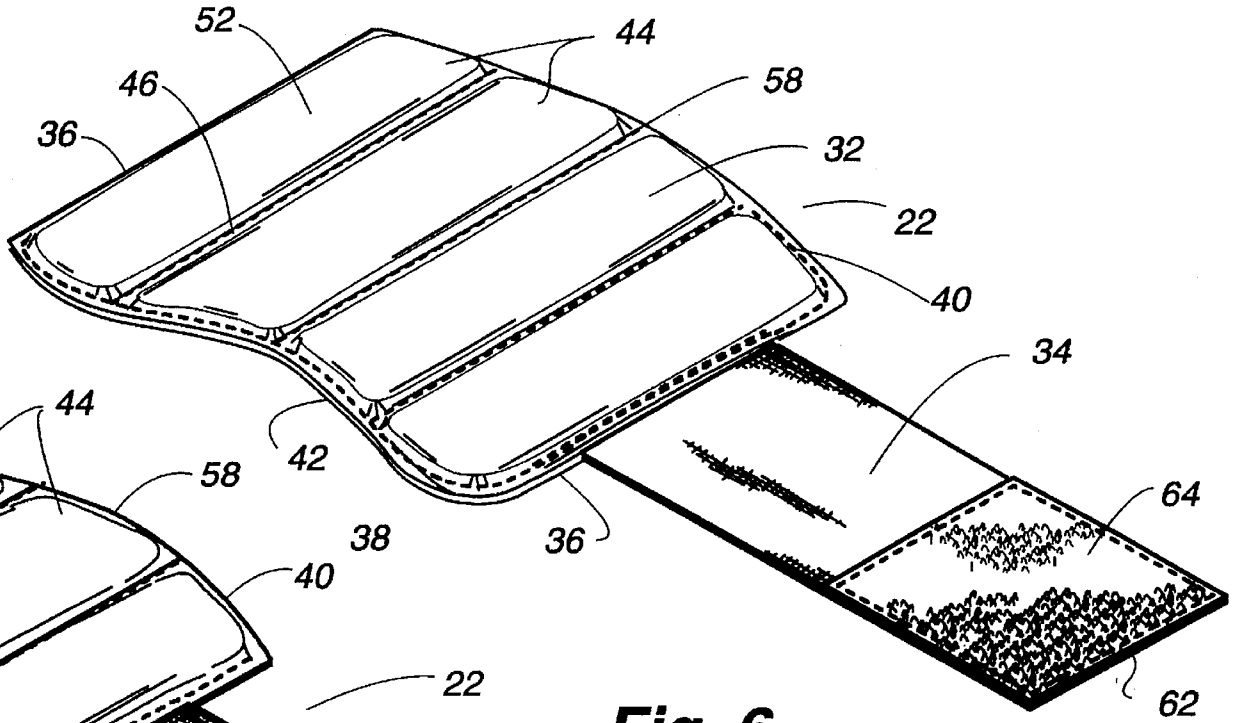
FIG. 6 is a perspective view of the bottom of the limb protector in an extended position having four protective compartments.
Figure 5:
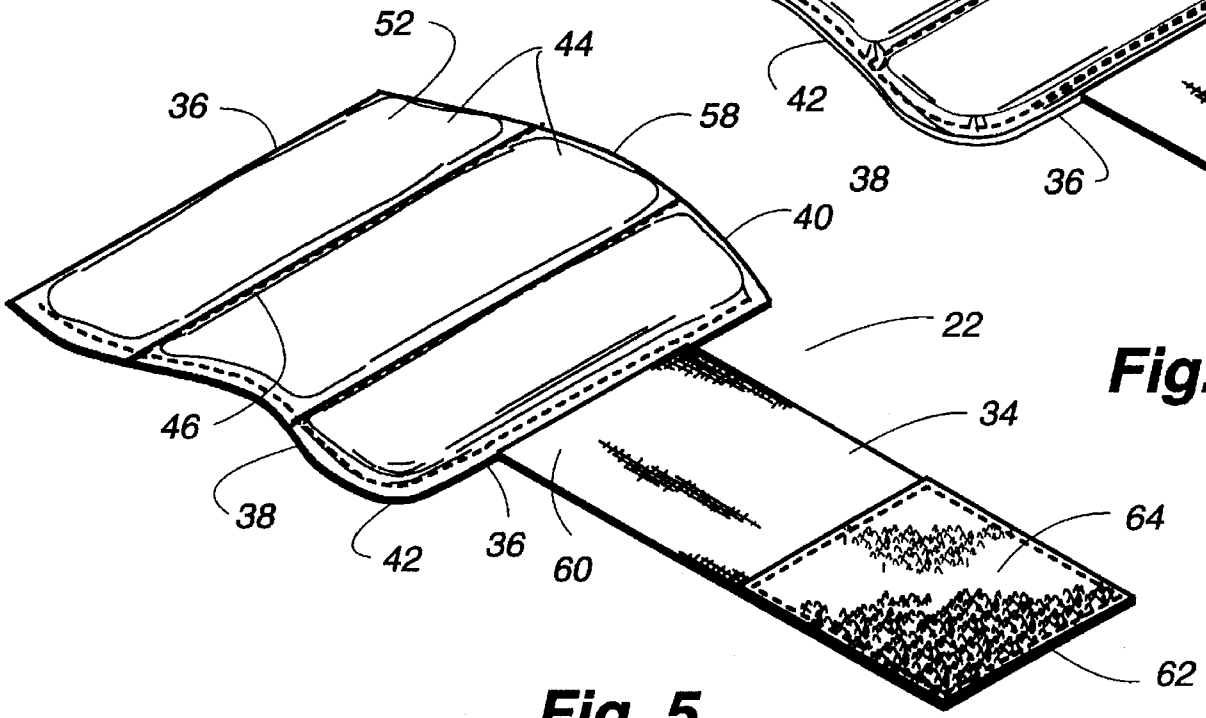
FIG. 5 is a perspective view of the bottom of the limb protector in an extended position having three protective compartments.

The arcuate concave shape of the front edge 38 is formed, as shown in FIGS. 2, 5 and 6, by the relative positioning of the adjacent protective compartments 44. The adjacent protective compartments are offset longitudinally from one another across the width of the main body member 32. The insert members positioned inside the protective compartments are also longitudinally offset from one another as their relative position is defined by the relative positions of the protective compartments 38. This offset positioning of the protective compartments and respective insert members also creates an arcuate convex shape in the rear edge 40 of the main body member 32. The arcuate convex shape of the rear edge 40 is also shown in FIGS. 2, 5 and 6.

The attachment strap 34 is an elongated and resilient member having a first end 60 fixed to the main body member 32, and a second free end 62 for attaching to the main body member after looping around the forearm 26. In the preferred embodiment, the free end 62 of the attachment strap 34 is releasably attached to the main body member 32 by any known method, such as hook-and-loop fasteners 64. The loop material is attached to a bottom side 63 of the strap 34, either along the entire length of the strap or adjacent to the free end 62. The hook material is attached to the main body member 32 on the top surface 50, adjacent to the side edge 36 opposite the side edge 36 where the first end 60 is attached to the main body member 32. The free end 62 can then be moved from the attached position (FIG. 4) to the free position (FIG. 2) to facilitate securely and comfortably placing the limb protector 22 on the forearm 26. The attachment strap 34 is resilient to allow a stretch-like characteristic for a snug fit on the forearm. This configuration allows for a custom fit, maximized protection, stable positioning, and minimizes any interference the limb protector 22 may have with the user's forearm movement 26.

Figure 4:
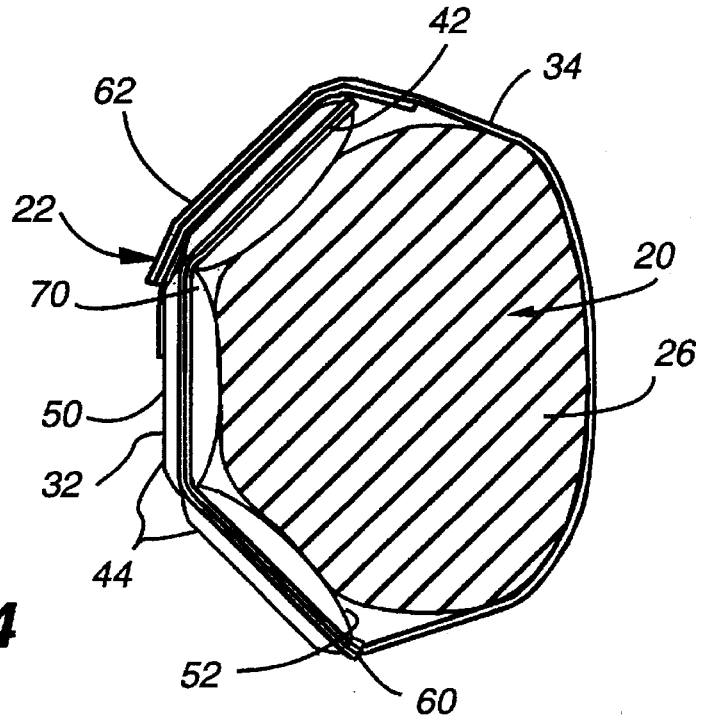
FIG. 4 is an enlarged section view taken along the line 4—4 of FIG. 1.

Referring to FIG. 4, the limb protector 22 is shown mounted on the forearm 26 of the user and oriented in an outwardly direction given the arm position shown in FIG. 1.

As can be seen in FIGS. 3 and 4, each protective compartment 44 has a thickness at a center position made up of the layering of the top surface 50, the insert member 48, the padding 56, and the bottom surface 52. The thickness is less at the line of connection 46, or the living hinge, formed between each of the protective compartments 44 where the top 50 and bottom 52 surfaces are attached directly together. This change in the thickness between the middle of the protective compartment 44 and the line of connection 46 between adjacent protective compartments 44 creates an indentation or trough 66 on both the top 50 and bottom 52 surfaces of the main body member 32 between adjacent protective compartments 44, as shown in FIGS. 3, 4, 5 and 6.

Each trough 66 has a bottom 68 defined by the line of connection 46, or living hinge, and diverging side walls 70 intersecting at the bottom 68. As shown in FIG. 3, the trough 66 along the top surface 50 of the main body member 32 has walls 70 defined by the top surface 50 extending from the bottom 68 outwardly over the insert member 48 inside the cavity 54 formed by the protective compartment 44. The trough 66 formed on the bottom surface 52 of the main body member 32 has diverging side walls 70 intersecting at the bottom 68 of the trough 66, the walls 68 being formed by the bottom surface 52 extending outwardly from the bottom 68 of the trough 66 and over the padding 56 which is positioned between the bottom surface 52 of the main body member 32 and the insert member 48.

The troughs 66 formed in the main body member 32 provide dual functionality. First, the troughs, formed by the connection of the top 50 and bottom 52 surfaces together along the lines of connection 46 between adjacent protective compartments 44, form the living hinges. The protective compartments 44 are able to pivot about the living hinge with respect to one another, as described above.

In addition, the troughs 66 along the bottom surface 52 of the main body member 32 assist in guarding the forearm 26 to which the limb protector 22 is attached from injury. As shown in FIG. 4, the trough defines a void 72 above the surface of the forearm 26. When the limb protector 22 is struck by an object, the force of the blow is transmitted to a fairly large surface by the insert member 48 in the protective compartment 44. If the insert member 48 is rigid, the force will be distributed over a large area to dissipate the force of the blow. If the insert member is silicone sheeting, which dissipates the blow somewhat within the sheeting structure itself, the blow is not dissipated over as large of an area but is still significantly reduced. In either event, the insert member 48 in turn moves toward the limb under the force of the blow and further dissipates the force of the blow through the padding 56.

The voids 72 defined by the troughs 66 also assist in dissipating the force of the blow by allowing each protective compartment 44 to move relatively independently in reaction to the blow, and compress or reduce the size of the void 72 to allow the protective compartments 44 to adjust and further lessen the impact force felt by the forearm 26.

FIG. 6 illustrates a limb protector 22 of the present invention having four protective compartments 44, as opposed to three protective compartments shown in FIG. 5. The extra protective compartments make the protector 22 larger for use on larger limbs. The larger protector includes all of the structural features and functional benefits previously discussed with respect to the three-protective-compartment embodiment. These include a concave arcuate shaped front edge 38 which allows for freedom of wrist movement when the protector 22 is positioned on the forearm 26 adjacent to the wrist 28, and also the previously described benefits of separate protective compartments.

In use, the limb protector 22 is positioned at the lower end of the forearm 26 adjacent to the wrist 28 such that the front arcuate concave edge 38 of the main body member 32 is positioned adjacent to the wrist 28 and the protective compartments 44 are oriented along the length of the forearm 26. The attachment strap 34 is then wrapped around the forearm 26 and stretched to the appropriate length and releasably secured to the main body member 32. When worn in this manner, and in the correct position on the forearm, the protector 22 will protect against severe blows and help prevent contusions and more serious injuries. The insert members 48 in each of the protective compartments 44 protect the forearm from impact, and the conforming shape of the protector 22 around the forearm 26 provides maximized protection of that area of the limb.

Although the present invention has been described with a certain degree of particularity, it is understood that the present disclosure has been made by way of example, and changes in detail or structure may be made without departing from the spirit of the invention, as defined in the appended claims.

The invention claimed is:

1. A limb protector attachable to a human limb, said protector comprising:

a. a main body member having a top surface, a bottom surface, a front, rear and opposing side edges along each of which the top and bottom surfaces are attached together, said edges defining a length and width of said main body member;

b. said main body member having a plurality of protective compartments oriented parallel to said opposing edges, said protective compartments extending the length of said main body member, each of said protective compartments defining an interior cavity, said plurality of protective compartments being adjacent to one another on said main body member, and being delineated from adjacent protective compartments by a line of connection;

c. said top and bottom surfaces being attached together along said line of connection between said adjacent protective compartments;

d. a living hinge formed along said line of connection between adjacent protective compartments, said living hinge allowing said protective compartments to pivot independently about said living hinge;

e. an elongated attachment strap having opposing ends, each of said opposing ends attached to one of said opposing edges for securely fastening said main body member to the limb;

f. an insert member positioned in each of said interior cavities;

g. padding material positioned in said interior cavity of each of said plurality of protective compartments and;

h. each of said compartments and interiorly positioned inserts being longitudinally offset from adjacent compartments, resulting in said front edge of said main body member having an arcuate concave shape when said main body member is laid flat.

2. A limb protector as defined in claim 1, wherein said arcuate concave shape of said front edge reaches an apex at a midpoint of said width of said main body member.

3. A limb protector as defined in claim 1, wherein said offset longitudinal compartments result in said rear edge of said main body member having an arcuate convex shape when said main body member is laid flat.

4. A limb protector as defined in claim 3, wherein said arcuate convex shape of said rear edge reaches an apex at a midpoint of said width.

* * * * *